United States Patent [19]

Abthoff et al.

[11] Patent Number: 4,621,604

[45] Date of Patent: Nov. 11, 1986

[54] FUEL INJECTION SYSTEM FOR A MIXTURE-COMPRESSING SPARK IGNITION INTERNAL-COMBUSTION ENGINE

[75] Inventors: Jörg Abthoff, Pluederhausen; Hans-Dieter Schuster, Schorndorf; Karlwalter Schmidt, Weinstadt, all of Fed. Rep. of Germany

[73] Assignee: Daimler-Benz Aktiengesellschaft, Stuttgart, Fed. Rep. of Germany

[21] Appl. No.: 717,008

[22] Filed: Mar. 28, 1985

[30] Foreign Application Priority Data

Mar. 28, 1984 [DE] Fed. Rep. of Germany ..... 3411333

[51] Int. Cl.[4] ..... F02M 39/00

[52] U.S. Cl. ..... 123/446; 123/459

[58] Field of Search ..... 123/446, 449, 452, 458, 123/459, 460

[56] References Cited

U.S. PATENT DOCUMENTS

| | | | |
|---|---|---|---|
| 3,481,315 | 12/1969 | Thornber | 123/460 |
| 3,996,910 | 12/1976 | Noguchi et al. | 123/449 |
| 4,197,058 | 4/1980 | Simko | 123/449 |
| 4,329,958 | 5/1982 | Wich | 123/449 |
| 4,425,893 | 1/1984 | McJones et al. | 123/446 |

FOREIGN PATENT DOCUMENTS

| | | | |
|---|---|---|---|
| 862973 | 11/1952 | Fed. Rep. of Germany | 123/460 |
| 2830675 | 1/1979 | Fed. Rep. of Germany . | |
| 2827321 | 1/1980 | Fed. Rep. of Germany . | |
| 45-24490 | 8/1970 | Japan | 123/449 |

*Primary Examiner*—Magdalen Y. C. Greenlief

*Attorney, Agent, or Firm*—Barnes & Thornburg

[57] ABSTRACT

A fuel injection system for a mixture-compressing spark ignition internal-combustion engine has a fuel-metering device having a housing with a control cylinder arranged therein, a control piston having at least two control edges being rotatably and longitudinally slidably arranged in said control cylinder. One front surface of said control piston is acted upon by fuel and its other front surface interacts with a pressure spring. Between the control edges, the control piston is equipped with a control space area. The housing has an inflow opening for a fuel inflow pipe, an outflow opening for a fuel return flow pipe in which a pressure regulating valve is arranged, and an outflow opening assigned to a fuel injection nozzle. The outflow opening connected with a control opening in the control cylinder interacts with the control edges. The control space area has at least one recess at the control piston having a circular-arc-shaped area segment forming the control edges in order to provide a fuel injection system having a fuel-metering device of the initially mentioned type which is simple to manufacture and easy to assemble, exhibits high operational reliability and ensures an exact metering of fuel. The axis of said area segment extends transversely to the control piston axis and starts from the circumferential area of the control piston in a concavely curved manner extends into the control piston. The control piston has an axial flow-through bore equipped with a throttle downstream from the recess. The fuel passes through said flow-through bore from the inflow opening of the housing to the recess and to the outflow opening of the housing.

18 Claims, 16 Drawing Figures

70
68
96
94
A'
93
69
67
97
22'
21'
71
B
B
94
A'
93
69
68

77
A'
74
78
79
72
75
22'
21'
B
B
76
A'
75
78
73

77
74
75
73
72
22'
21'
A'
B
B
76
79

A'
83
87
80
81
22'
21'
85
B
B
86
A''
84
82

FUEL INJECTION SYSTEM FOR A MIXTURE-COMPRESSING SPARK IGNITION INTERNAL-COMBUSTION ENGINE

BACKGROUND AND SUMMARY OF THE INVENTION

This invention relates to a fuel injection system for a mixture-compressing spark ignition internal-combustion engine, and particularly to a fuel-metering system to provide exact metering of the quantity of fuel to be injected into each cylinder of the internal-combustion engine.

On the basis of DE-PS No. 31 43 492, a mixture-compressing spark ignition internal-combustion engine for motor vehicles is known having a main combustion chamber and a precombustion chamber where a spark plug and a precombustion chamber injection nozzle are arranged. The precombustion chamber injection nozzle can be switched on and off as a function of the load, and the quantity of its injection can be influenced as a function of the load. In this case, fuel is supplied to the precombustion chamber injection nozzle via a typical fuel-metering device. The shifting of the control piston in this case takes place only by means of the fuel acting upon one front side of the control piston in cooperation with the pressure spring. In the case of this fuel-metering device, the fuel has no other function than that of acting upon one front side of the control piston. The control piston has a sloped control edge by means of which the fuel supply is controlled via control openings to several injection nozzles. For this purpose an exact positioning of all control openings in axial direction is required. The control piston is driven by the camshaft. For this purpose, the control piston has a blocking journal on the end side provided with a blocking slot. The blocking journal is guided in a pocket bore in a control journal of the camshaft. Here an additional sealing at the control piston is required, and this control piston must be arranged so that it is in alignment with the camshaft.

One object of the present invention is to provide a fuel injection system for a mixture-compressing spark ignition internal-combustion engine having a fuel metering device that is simple to manufacture and easy to assemble, exhibits extreme operational reliability, and ensures an exact metering of fuel.

An exact metering of the quantity of fuel to be injected separately into each cylinder of the internal-combustion engine is made possible by means of the fuel injection system according to the present invention. In order to achieve an identical injected quantity in the case of all fuel metering devices, the prestressing of the pressure springs is affected by an adjustment of the motor housing parts and the parts of the control piston housing with respect to one another. Repercussions on the fuel quantity by characteristic-line tolerances of the pressure springs are balanced by the adjusting screws. A constant fuel-air mixture ratio can be achieved by correct coordination of the air volume meter, the pressure regulator in the final return line, the pressure spring, and the circular-arc-shaped area segment. The circular-arc-shaped area segments permit a linear control of the fuel quantity to be injected via an axial shifting of the control pistons. The tangential start of the surface segments permits the linear start of the fuel quantity to be injected starting from zero. The fuel cools not only the electric motor but also the control pistons resulting in the avoidance of the formation of steam bubbles at the control openings. The hydraulic coupling of the fuel-metering devices and the arrangement of an electric motor in each fuel metering device permits the arrangement of said fuel-metering device in each fitting position. The electric motor must not be aligned exactly with the control piston, and sealings at the side of the drive are not necessary. The fuel injection system of the present invention can be built from identical structural parts for all internal-combustion engines - irrespective of the number of cylinders - due to the provision of a fuel-metering device for each cylinder of the internal-combustion engine. If, for example, two recesses are provided that are arranged at the circumference of the control piston so that they are evenly distributed, the pressure force of the control piston on the control cylinder is very little so that electric motors with only a low driving capacity are required.

Further objects, features, and advantages of the present invention will become more apparent from the following description when taken with the accompanying drawings which show, for purpose of illustration only, preferred embodiments in accordance with the present invention.

DETAILED DESCRIPTION OF THE DRAWINGS

Figure 1:
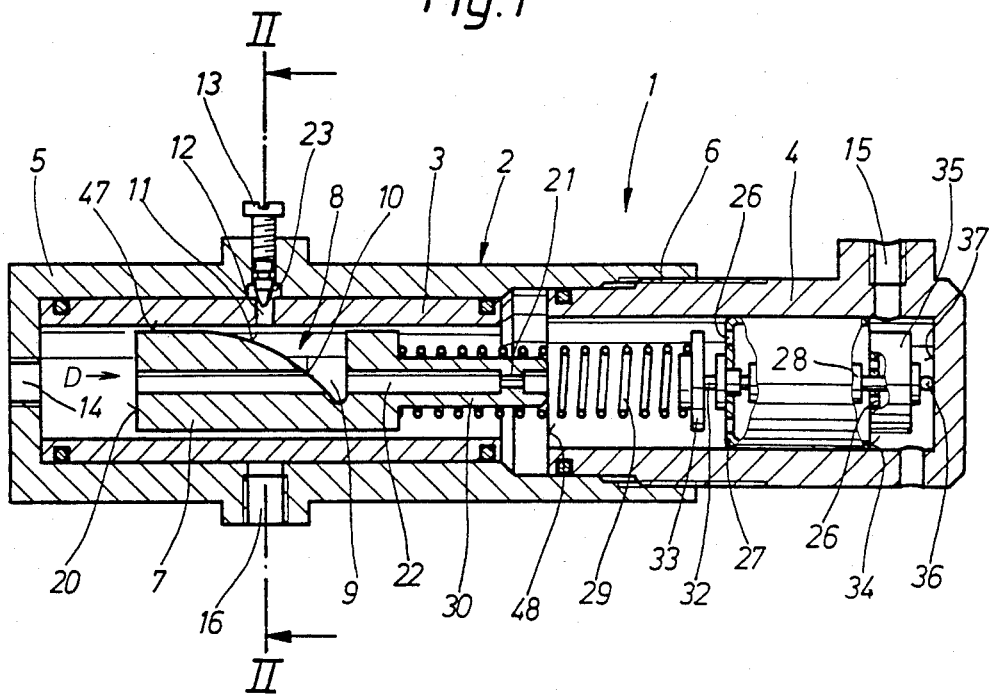
FIG. 1 is a longitudinal section of the fuel metering device of the present invention.
Figure 2:
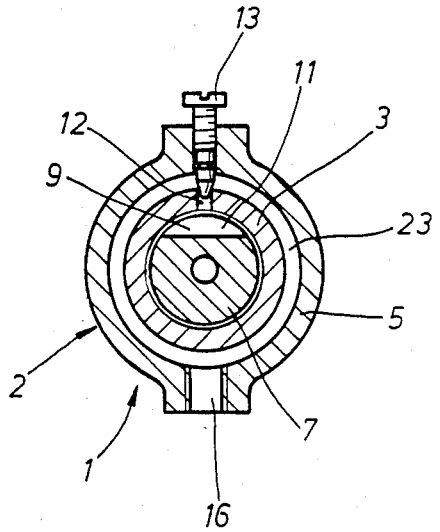
FIG. 2 is a section according to Line II—II of FIG. 1.
Figure 3:
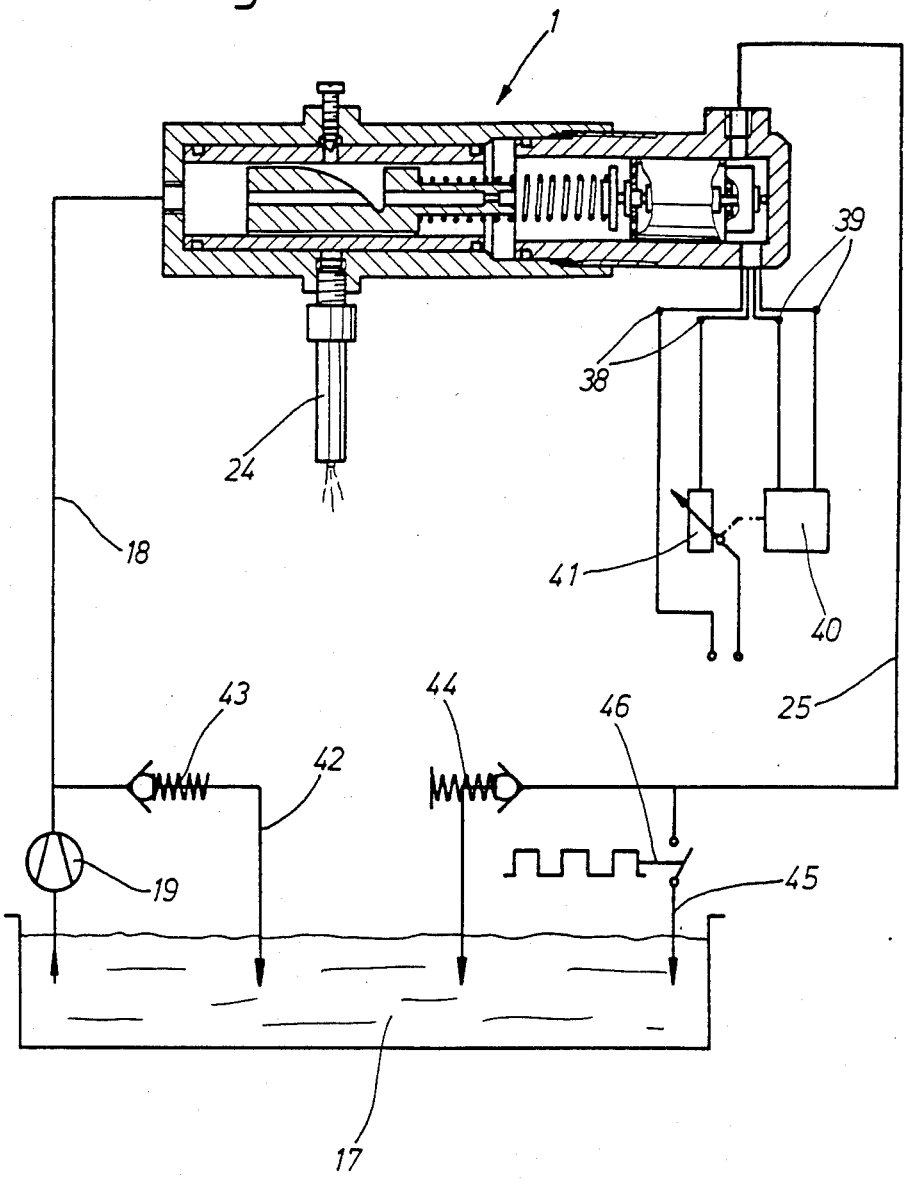
FIG. 3 is a diagram of a fuel injection system with the fuel metering system according to FIG. 1.
Figure 4:
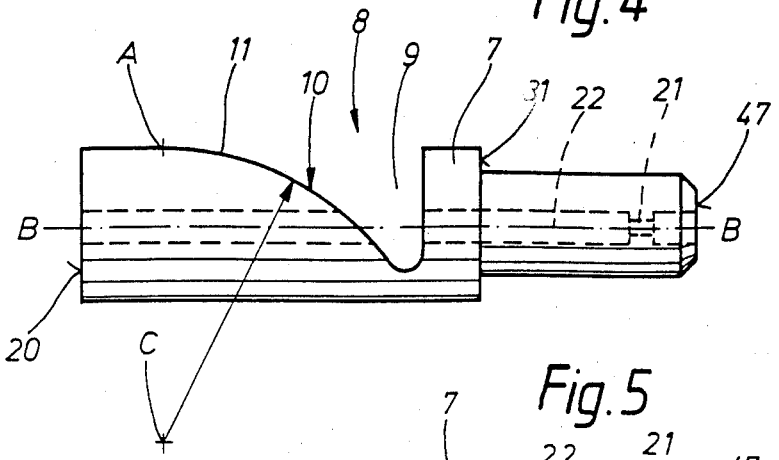
FIG. 4 is a lateral view of the control piston according to FIGS. 1 and 2.
Figure 5:
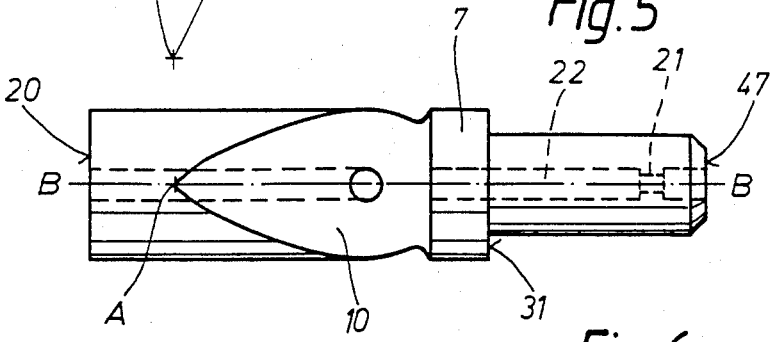
FIG. 5 is a top view of the control piston according to FIG. 4.

In FIGS. 1 to 5, a fuel-metering device has the reference number 1, said fuel-metering device 1 having a housing 2 with a control cylinder 3 disposed therein. The housing 2 consists of a motor housing part 4 and a control piston housing part 5 which are adjustable with respect to one another in an axial direction by means of a threaded connection 6. In the control cylinder 3, a control piston 7 is pivotably and longitudinally slidably arranged having a control area 8. Said control area comprises a recess 9 at the control piston 7 with a circular-arc shaped area segment 10, the combined area of which, together with the slide shell area, form two control edges 11 interacting with a control opening 12 in the control cylinder. The cross-section of the control opening 12 can be influenced by an adjusting screw 13 arranged at the housing 2. The housing 2 is provided with an inflow opening 14, an outflow opening 15, and an outflow opening 16 which is connected with the control opening 12.

Fuel is supplied to the fuel-metering device 1 from a fuel tank 17 via a fuel inflow pipe 18 and a fuel pump 19 arranged therein through the inflow opening 14. The fuel acts upon the front surface 20 of the control piston 7 and flows through an axial flow-through bore 22 provided with a throttle 21 in the control piston. A part of the fuel flows from the flow-through bore 22 into the recess 9 and from there through the control opening 12 and an annulus 23 in the control piston housing part 5 to the outflow opening 16 in which a fuel injection nozzle 24 is arranged. The part of the fuel that is not directed to the fuel injection nozzle 24, via the throttle 21 flows to the outflow opening 15 and from there, through a fuel return pipe 25 back to the fuel tank 17. In this case, this part of the fuel flows through the motor housing 27 provided with flow-through openings 26.

An electric motor 28 is arranged in the motor housing part 4, said electric motor 28 driving the control piston 7 via a pressure spring 29. The pressure spring 29 is partly guided on a pilot 30 of the control piston 7 and with one end is fastened at a fastening surface 31 of the control piston 7 and with the other end at a fastening flange 33 that is arranged on the shaft 32 of the electric motor 28 in a rotatably stable manner. A tachometer generator 35 is arranged at the front surface 34 of the motor housing 27 that faces away from the pressure spring 29. The tachometer generator 35 is supported by a ball 36 on the interior front side 37 of the motor housing part 4. The speed of the electric motor 28 can be kept constant by the regulating of the supply voltage at the terminals 38 for the electric motor 28 via the output of the tachometer generator 35 at the terminals 39 by means of an electronic regulator and a resistor 41.

A fuel pipe 42 branches off the fuel supply pipe 18 by operation of a pressure regulating valve 43 in said fuel pipe 42 when the pressure in the fuel supply pipe 18 is too high to cause fuel to flow back into the fuel tank 17 from said fuel supply pipe 18. A pressure regulating valve 44 is also switched into the fuel return pipe 25. The pressure regulating valve 44 regulates the fuel pressure in the fuel return pipe 25, for example, as a function of the air flowing in the internal-combustion engine. A fuel pipe 45 branches off the fuel return pipe 25 in which a return valve 46 (pressure regulating valve) is arranged which is, for example, also timed as a function of the air throughput in the internal-combustion engine. This return flow valve 46 causes fuel to flow back from the fuel return pipe 25 through the fuel pipe 45 into the fuel tank 17. The return flow valve 46 can be used alone in the illustrated fuel injection system, together with the pressure regulating valve 44, or the pressure regulating valve 44 can be used alone in the illustrated fuel injection system.

The circular-arc-shaped area segment 10 at the control piston 7 extends in the direction of the throttle 21 starting from a point A of the control piston shell surface 11 located at a distance to the front surface 20 of the control piston 7 acted upon by the fuel, in a concavely curved manner, to below the axis B—B of the control piston into the control piston 7 and its axis C is located transversely to the control piston axis B—B.

The fuel delivered by the fuel pump 19 from the fuel tank 17, at a constant pressure P1, flows through the inflow opening 14 into the control cylinder 3 and acts upon the front surface 20 of the control piston 7 so that said control piston 7 is shifted against the force of the pressure spring 29 in the direction of the arrow D. The fuel flows through the flow-through bore 22 partly into the recess 9 and from there through the control opening 12, the annulus 23 and the flow-out opening 16 to the fuel injection nozzle 24, and partly through the throttle, the flow-through openings 26 in the motor housing 27, the outflow opening 15, the fuel return pipe 25 and the pressure regulating valve 44 and/or the fuel pipe 45 and the return flow valve 46 back into the fuel tank 17. The fuel, with a pressure P3 that can be influenced by means of the adjusting screw 13 by changing the flow-through cross-section of the control opening 12, reaches the injection nozzle 24, and comes out of the outflow opening 15 with a pressure P2 which, because of the throttle 21, is lower than the pressure P1 and is influenced by the pressure regulating valve 44 and/or the return flow valve 46.

The fuel quantity flowing to the fuel injection nozzle 24 is controlled by the axial position of the control edges 11 to the control opening 12. This axial position is influenced by the pressure difference between the pressure P1 affecting the front side 20 of the control piston 7, on the one hand, and the spring force of the pressure spring 29 and the pressure P2 affecting the front side 48 and the fastening surface 31, on the other hand. The fuel quantity is proportional to the ratio of the time in which the control opening 12 controlled by the control edge 11 is connected with the recess 9 and the time in which the control piston 7 makes one rotation. The duration of the connection between the control opening 12 and the recess 9 becomes linearly larger starting from point A with increasing axial shifting of the control piston 7 when the radius of the circular-arc-shaped area segment 10 is equal to the radius of the control piston 7.

Figure 6:
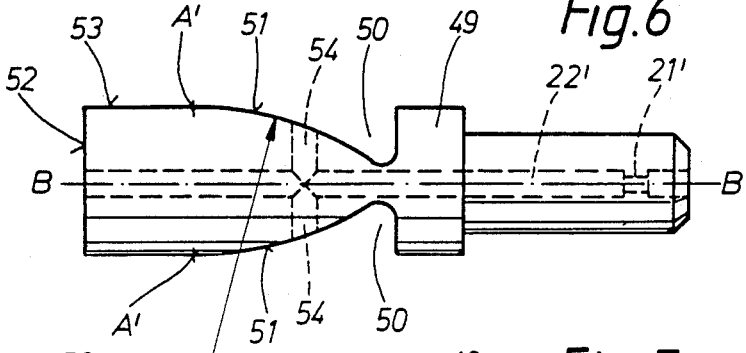
FIG. 6 is another lateral view of another embodiment of a control piston.
Figure 7:
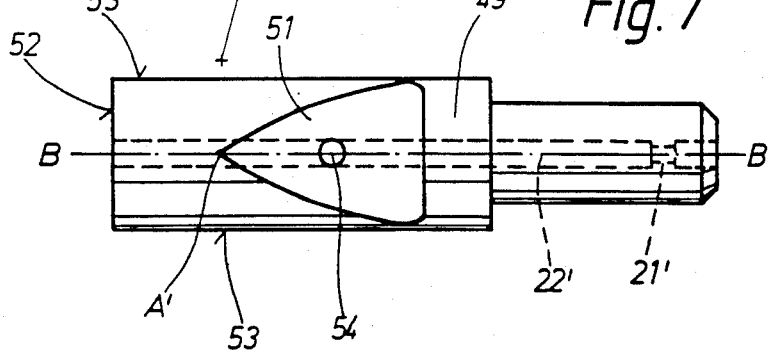
FIG. 7 is a top view of the control piston according to FIG. 6.

The control piston 49 of FIGS. 6 and 7 has recesses 50 that are arranged evenly distributed at the circumference, the circular-arc-shaped area segments 51 of said recesses 50, extending in the direction of the throttle 21′ arranged in the through-flow bore 22′, starting at point A′ of the control piston shell surface 53 located at a distance to the front surface 52 of the control piston 49 acted upon by the fuel, to above the control piston axis B—B into the control piston 49. The recesses 50, by means of cross holes 54, are connected with the flow-through bore 22′.

Figure 8:
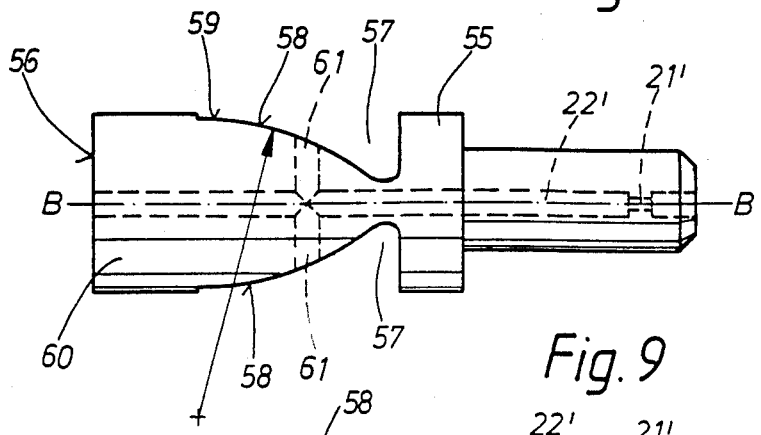
FIG. 8 is a lateral view of another embodiment of a control piston.
Figure 9:
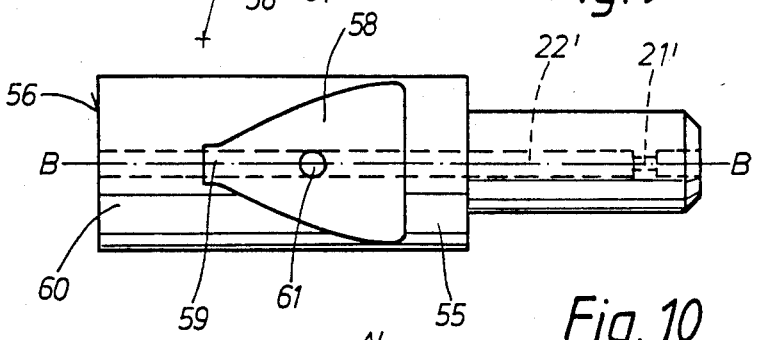
FIG. 9 is a top view of the control piston of FIG. 8.

The control piston 55 of FIGS. 8 and 9 has two recesses 57 arranged evenly distributed at the circumference, said recesses 57 being provided with control surfaces 59 which are staggered with respect to a cylindrical part 60 containing the front surface 56 acted upon by the fuel and are located in parallel to the control piston axis B—B. Following these control surfaces 59 are the circular-arc-shaped area segments 58 which extend in the direction of the throttle 21′ arranged in the flow-through bore 22′ to above the control piston axis B—B into the control piston. The recesses 57 are connected with the flow-through bore 22′ by means of cross holes 61.

Figure 10:
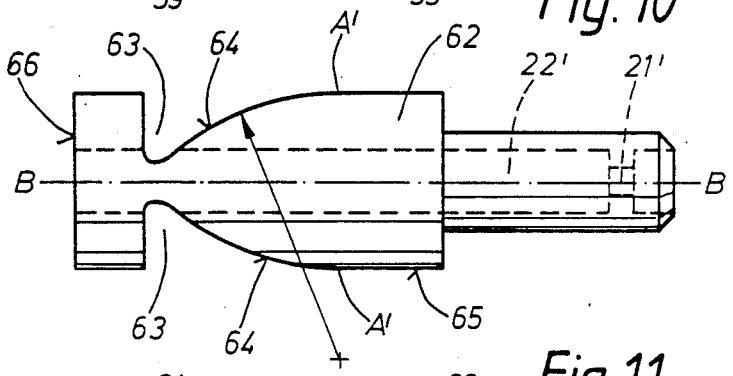
FIG. 10 is a lateral view of another embodiment of a control piston.
Figure 11:
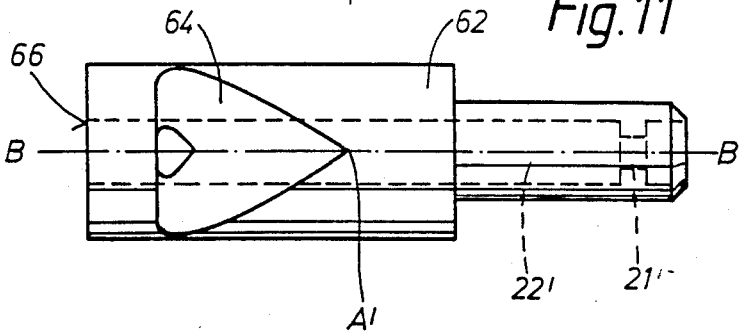
FIG. 11 is a top view of the control piston of FIG. 10.

The control piston 62 of FIGS. 10 and 11 has two recesses 63 arranged evenly distributed at the circumference, the circular-arc-shaped area segments 64 of said recesses 63 extending in the direction of the front surface 66 of the control piston 62 acted upon by the fuel from points A' of the control piston shell surface 65 to above the control piston axis B—B into the control piston 63.

Figure 12:
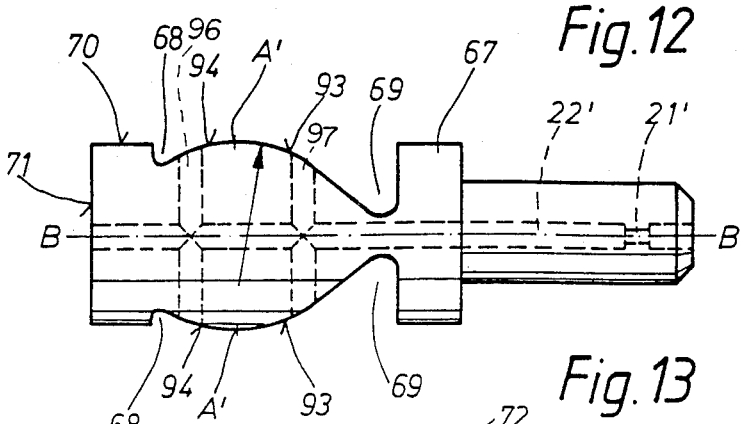
FIG. 12 is a lateral view of another embodiment of a control piston.

The control piston 67 according to FIG. 12 has four recesses 68 and 69 that are located behind one another in pairs and are arranged evenly distributed at the circumference in such a way that the circular-arc-shaped area segments 93 of one pair 69 of recesses, starting from points A' of the control piston shell surface 70 extend in the direction of the throttle 21', and the circular-arc shaped area segments 94 of the other pair 68 of recesses, starting from points A' extend in the direction of the front surface 71 of the control piston 67 acted upon by the fuel, to above the control piston axis B—B into the control piston 67. One pair 68 of recesses in this case extends with a different depth to above the control piston axis B—B into the control piston than the other pair 69 of recesses. The recesses 68 are connected with the flow-through bore 22' by means of cross holes 96 and the recesses 69 are connected with the flow-through bore 22' by means of cross holes 97.

Figure 13:
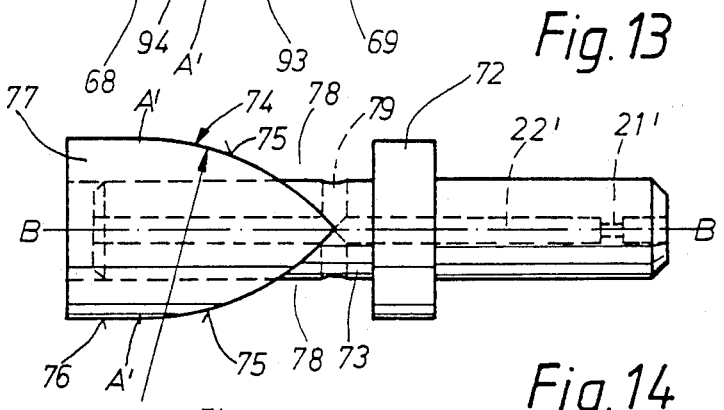
FIG. 13 is a lateral view of another embodiment of a control piston.
Figure 14:
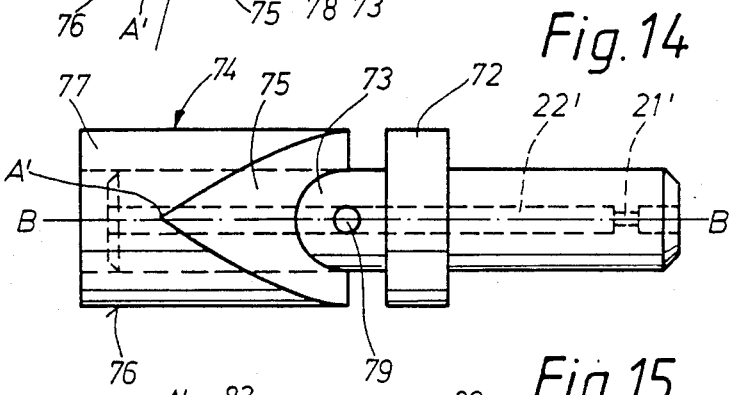
FIG. 14 is a top view of the control piston of FIG. 13.

In the case of the control piston 72 of FIGS. 13 and 14, a molded cylindrical body 74 having two circular-arc-shaped area segments 75 arranged evenly distributed at the circumference is fastened on a cylindrical taper 73, said area segments 75 extending in the direction of the throttle 21' starting from points A' at the shell surface 76 of the cylindrical part 77 of the molded body 74 having the diameter of the control piston 72 to the control piston axis B—B. The recesses 78 formed in the area of the area segments 75, are connected with the flow-through bore 22' by means of cross holes 79.

Figure 15:
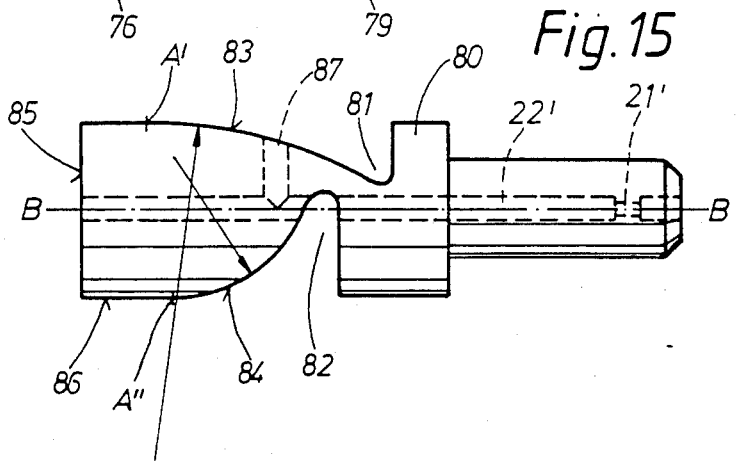
FIG. 15 is a lateral view of another embodiment of a control piston.

The control piston 80 of FIG. 15 has two recesses 81, 82 that are arranged evenly distributed at the circumference, the circular-arc-shaped area segments 83, 84 of which having different radii. The area segments 83, 84 extend in the direction of the throttle 21' from points A', A'' of the control piston shell surface 86 located at different distances from the front surface 85 and are acted upon by the fuel into the control piston 80 in such a way that one area segment 83 ends above the piston control axis B—B and the other area segment 84 ends below the control piston axis B—B at a different distance to the front surface 85 acted upon by the fuel. The recess 81 is connected with the flow-through bore 22' by means of a cross hole 87.

Figure 16:
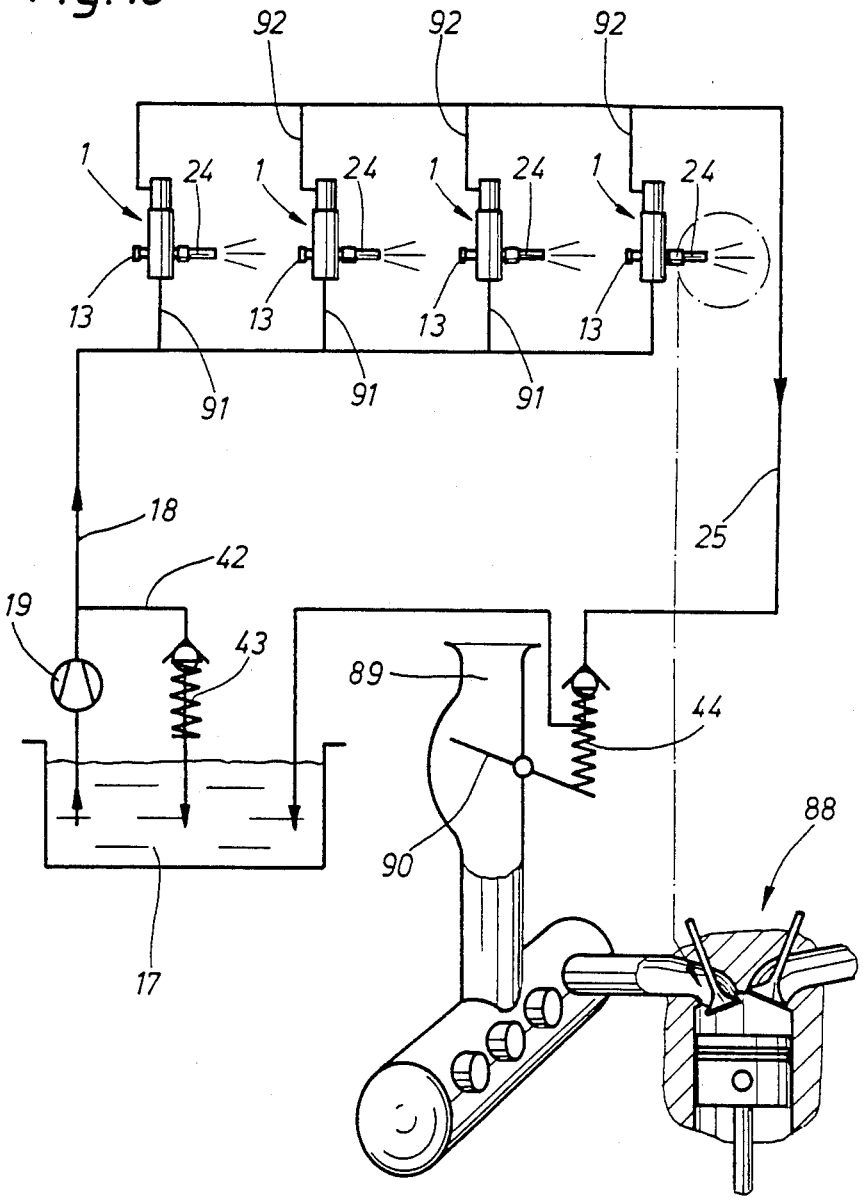
FIG. 16 is a diagram of a fuel injection system having the fuel-metering device according to FIG. 1 for an internal-combustion engine having an air volume meter arranged in its main section pipe.

FIG. 16 shows a diagram of a fuel injection system for a four-cylinder internal-combustion engine 88, a conventional air volume meter 90 being arranged in the main suction pipe 89 of said internal-combustion engine 88. For each cylinder of the internal-combustion engine 88, the fuel injection system comprises one fuel-metering device 1 connected in parallel between the pressures P1 and P2. In this case, three of the four fuel-metering devices 1 are connected by means of fuel pipes 91 with the fuel inflow pipe 18, and three of the four fuel-metering devices 1 are connected with the fuel return-flow pipe 25 by means of fuel pipes 92. The pressure regulating valve 44 in the fuel return-flow pipe 25 is actuated by the air volume meter 90 and the pressure P2 is regulated in such a way that the pressure P2 increases with rising air volume. As a result, the fuel quantity supplied to the fuel injection nozzles 24 is increased. For the synchronization of the individual fuel-metering devices with respect to the fuel quantity to be injected, the prestressing of the pressure springs 29 is influenced by an adjustment of the motor housing parts 4 and the control piston housing part 5 with respect to one another. Repercussions on the fuel quantity by means of characteristic-line tolerances of the pressure spring 29 are balanced by means of the adjusting screws 13. In the case of a correct coordination of the air volume meter 90, the pressure regulating valve 44, the pressure springs 29 and the circular-arc-shaped area segments, the ratio of the air volume and the fuel quantity in the cylinders of the internal-combustion engine 88 will be constant.

Intentional deviations, as required during cold start, warming-up, cut-off of thrust, Lambda-control (Lambda probe) and acceleration upgrading, may be caused by a variation of the pressure P1 affecting the front side 20. A lowering of P1, because of the change of the slide position in the direction of the front surface 20, causes a slight greasing although the pressure falls at the control opening 12.

Deviating from the indicated embodiments, other alternative embodiments are possible. Thus the air volume measured by the air volume meter may also be recorded electronically, and by means of digital signals, the timed pressure regulating valve 46 can be controlled corresponding to the pressure regulating valve 44. The turning of the control piston may take place by means of a hydrostatic device, such as a vane cell motor, or a hydrodynamic device, such as a turbine, by means of the fuel flowing through. Also, the drive of the control piston may take place in such a way that the control piston at the same time forms the armature of the electric motor and the magnetic flux acts through the control cylinder. In this case, the magnetic forces also act in axial direction and may replace the pressure spring in the case of a corresponding design.

Although the invention has been described in detail with reference to certain preferred embodiments and specific examples, variations and modificatons exist within the scope and spirit of the invention as described and defined in the following claims.

What is claimed is:

1. A fuel injection system for a mixture-compressing spark ignition internal-combustion engine having a fuel-metering device comprising a housing with a control cylinder arranged therein, a control piston having at least two control edges rotatably and longitudinally slidably arranged in said control cylinder, one front surface of said control piston being acted upon by fuel and the other front surface of said control piston interacting with a pressure spring, and being provided with a control space area between the control edges, and the housing having an inflow opening for a fuel inflow pipe, an outflow opening for a fuel return-flow pipe in which a pressure regulating valve is arranged, and an outflow opening assigned to a fuel injection nozzle, said outflow opening being connected with a control opening in the control cylinder interacting with the control edges, wherein the control space area includes at least one recess at the control piston having a circular-arc-shaped area segment forming the control edges, the axis of said area segment extending transversely to the control piston axis and which starting at the circumferential area of the control piston extends into it in a concavely curved manner, and wherein the control piston has an axial flow-through bore equipped with a throttle downstream from the recesses, the fuel flowing through said flow-through bore from the inflow opening of the housing to the recesses and to the outflow opening of the housing.

2. A fuel injection system according to claim 1, wherein the control piston has a recess, the circular-arc-shaped area segment of which extends in the direction of the throttle, starting from a point of the control piston shell surface located at a distance from the front surface of the control piston acted upon by the fuel to below the control piston axis in the control piston.

3. A fuel injection system according to claim 1, wherein the control piston has two recesses arranged evenly distributed at the circumference, the circular-arc-shaped area segments of said recesses extending in the direction of the throttle starting from points of the control piston shell surface located at a distance from the front surface of the control piston acted upon by the fuel to above the control piston axis into the control piston.

4. A fuel injection system according to claim 1, wherein the control piston has two recesses arranged evenly distributed at the circumference, said recesses having control surfaces that are staggered with respect to a cylindrical part comprising the front surface acted upon by the fuel and are disposed in parallel to the control piston axis, said control surfaces being followed by the circular-arc-shaped area segments extending in the direction of the throttle to above the control piston axis into the control piston.

5. A fuel injection system according to claim 1, wherein the control piston has two recesses arranged evenly distributed at the circumference, the circular-arc-shaped area segments of said recesses extending in the direction of the front surface of the control piston acted upon by the fuel, starting from points of the control piston shell surface to above the control piston axis into the control piston.

6. A fuel injection system according to claim 1 wherein the control piston has four recesses arranged in pairs behind one another and evenly distributed at the circumference in such a way that the circular-arc-shaped area segments of one pair of recesses, starting from points of the control piston shell surface extend in the direction of the throttle, and the circular-arc-shaped segments of the other pair of recesses extend in the direction of the front surface of the control piston acted upon by the fuel starting from points of the control piston shell surface to above the control piston axis into the control piston.

7. A fuel injection system according to claim 6, wherein one pair of recesses extends to above the control piston axis into the control piston with a different depth than the other pair of recesses.

8. A fuel injection system according to claim 1, wherein a cylindrical molded body having two circular-segment-shaped area segments arranged evenly distributed at the circumference is fastened on a cylindrical taper of the control piston, said circular-arc-shaped area segments extending in the direction of the throttle starting from points at the shell surface of the cylindrical part of the molded body having the diameter of the control piston to the control piston axis.

9. A fuel injection system according to claim 1, wherein the control piston has two recesses arranged evenly distributed at the circumference, the circular-arc-shaped area segments of said recesses having different radii and extending from points of the control piston shell surface located at different distances from the front surface acted upon by the fuel, in the direction of the throttle in such a way into the control piston that one area segment ends above the control piston axis and the other area segment ends below the control piston axis at a different distance from the front surface acted upon by the fuel.

10. A fuel injection system according to claim 1, wherein the at least one recess is connected with the flow-through bore of the control piston by means of cross holes.

11. A fuel injection system according to claim 1 wherein the control piston is driven by an electric motor arranged in the housing.

12. A fuel injection system according to claim 11, wherein the motor housing of the electric motor has openings through which the fuel passes that flows to the outflow opening for the fuel return-flow pipe.

13. A fuel injection system according to claim 1, wherein the housing comprises a motor housing part and a control piston housing part which can be adjusted with respect to one another in axial direction by means of a threaded connection.

14. A fuel injection system according to claim 1 wherein the control piston is driven by an electric motor via the pressure spring interacting with the control piston.

15. A fuel injection system according to claim 11, wherein a tachometer generator is assigned to the electric motor by means of which the speed of the electric motor can be controlled.

16. A fuel injection system according to claim 14, wherein a tachometer generator is assigned to the electric motor by means of which the speed of the electric motor can be controlled.

17. A fuel injection system according to claim 1, an air volume meter being arranged in a main suction pipe of the internal-combustion engine, wherein the pressure regulating valve controlling the pressure of the fuel flowing from the outflow opening of the housing into the fuel return flow pipe is influenced by the air volume meter.

18. A fuel-metering device for use in a fuel injection system of a spark-ignition internal-combustion engine, the fuel-metering device comprising a housing formed to include a fuel inflow opening, a control piston movable in the housing, the control piston including a front surface positioned to intercept fuel introduced into the housing as it flows along a path toward the engine, and a control area spring means for yieldably biasing the control piston toward the fuel inflow opening of the housing, and wherein the control space area includes at least one recess at the control piston having a circular-arc-shaped area segment forming a control edges, the axis of said area segment extending transversely to the control piston axis and which starting at the circumferential area of the control piston extends into it in a concavely curved manner, and wherein the control piston has an axial flow-through bore equipped with a throttle downstream from the recesses, the fuel flowing through said flow-through bore from the inflow opening of the housing to the recesses and to the outflow opening of the housing.

* * * * *